US011641878B2

(12) United States Patent
Li et al.

(10) Patent No.: US 11,641,878 B2
(45) Date of Patent: May 9, 2023

(54) AEROSOL-GENERATING DEVICE

(71) Applicants: SHANGHAI NEW TOBACCO PRODUCT RESEARCH INSTITUTE, Shanghai (CN); SHANGHAI TOBACCO GROUP CO., LTD, Shanghai (CN)

(72) Inventors: Xianglin Li, Shanghai (CN); Wenjie Lu, Shanghai (CN); Jianghong Qu, Shanghai (CN); Bin Nie, Shanghai (CN)

( * ) Notice: Subject to any disclaimer, the term of this patent is extended or adjusted under 35 U.S.C. 154(b) by 321 days.

(21) Appl. No.: 15/733,264

(22) PCT Filed: Mar. 13, 2018

(86) PCT No.: PCT/CN2018/078864
§ 371 (c)(1),
(2) Date: Jun. 18, 2020

(87) PCT Pub. No.: WO2019/119650
PCT Pub. Date: Jun. 27, 2019

(65) Prior Publication Data

US 2021/0015155 A1 Jan. 21, 2021

(30) Foreign Application Priority Data

Dec. 19, 2017 (CN) ..... 201711376329.8

(51) Int. Cl.

| | |
|---|---|
| ***A24F 40/42*** | (2020.01) |
| ***A24F 40/46*** | (2020.01) |
| ***A24F 40/40*** | (2020.01) |
| *A24F 40/20* | (2020.01) |

(52) U.S. Cl.
CPC ..... *A24F 40/40* (2020.01); *A24F 40/42* (2020.01); *A24F 40/46* (2020.01); *A24F 40/20* (2020.01)

(58) Field of Classification Search
None
See application file for complete search history.

(56) References Cited

U.S. PATENT DOCUMENTS 9,693,587 B2 * 7/2017 Plojoux ..... A24F 40/40

FOREIGN PATENT DOCUMENTS

| | | |
|---|---|---|
| CN | 103997922 A | 8/2014 |
| CN | 106473232 A | 3/2017 |
| EP | 3632241 A1 | 4/2020 |

* cited by examiner

*Primary Examiner* — Dennis R Cordray
(74) *Attorney, Agent, or Firm* — Superior IP, PLLC; Dustin Lee Call

(57) ABSTRACT

An aerosol-generating device. The cavity defined together by the storage portion and the mouthpiece for accommodating the aerosol-generating substrate can effectively fix the aerosol-generating substrate, hereby preventing the aerosol-generating substrate or a tobacco residue from falling during a smoking process. In addition, when a user directly pulls an extractor out of a main body, that is, the storage portion and the mouthpiece are subjected to an axially force, the mouthpiece can radially expand outward such that the mouthpiece is separated from the storage portion. Before the extractor is detached from the main body, the main body would restrict the end of the mouthpiece adjacent to the main body from radially expanding outward.

18 Claims, 3 Drawing Sheets

AEROSOL-GENERATING DEVICE

FIELD OF THE DISCLOSURE

The present disclosure relates to tobacco technology, and more specifically to an aerosol-generating device.

BACKGROUND OF ART

In recent years, with the increasing attention to health, people are aware of the harm of traditional cigarettes to health. The adverse effects of traditional cigarettes on health and environment have been concerned by countries all over the world. Tobacco producers have committed to provide consumers with less harmful tobacco products. Therefore, low-temperature heating and none-burning tobacco products, as a new form of tobacco consumption, have gradually gained popularity in the market and have been increasingly accepted by cigarette consumers over the world.

In the prior art, low-temperature heating and none burning tobacco products are usually provided with a heating cavity for accommodating a special cigarette, which the heater pierces for heating the tobacco so as to generate an aerosol. After smoking, the user can directly take out the cigarette and replace it with a new one. However, since the tobacco residue tends to adhere to the surface of the heater after heating, it is difficult to clean the heater. Also because of the adhesion force of the heater to the tobacco, the integrity of the cigarette is likely to be destroyed when directly taken out, resulting in the tobacco being scattered in the heating cavity and the removal difficulty.

PHILIP MORRIS PRODUCTS S.A. disclosed an aerosol-generating device configured to receive a smoking article comprising an aerosol-forming substrate. The device comprises a heater for heating the aerosol-forming substrate to form the aerosol. An extractor is configured to extract the smoking article received in the aerosol-generating device, and includes a sliding receptacle configured to receive the smoking article, and a sleeve configured to receive the sliding receptacle. The sliding receptacle is slidable in the sleeve between a first position, in which the substrate of the smoking article is positioned so as to be heated by the heater, and a second position, in which the substrate is substantially separated from the heater. In this technical solution, by the sliding receptacle sliding from the first position to the second position, the tobacco residue adhering to the surface of the heater can be scraped off, and the integrity of the cigarette is maintained. The cigarette is taken out when the receptacle is at the second position, and it is possible to prevent the tobacco left in the sliding receptacle. However, this aerosol-generating device does not have a mouthpiece, and one end of the cigarette is directly exposed to the outside. Moreover, the cigarette is fixed directly in the sliding receptacle by a clamping device on the sliding receptacle in the first position. If a user does not slide the sliding receptacle from the first position to the second position after smoking, and directly pulls it out at the first position, part of the tobacco will be left in the device since the cigarette is still clamped in the sliding receptacle by the clamping device, and making the removal difficult.

In addition, China Tobacco Industry (Hubei) Co., Ltd. also disclosed an electric heating device similar to the above where the cigarette can be taken out easily. No mouthpiece is provided, and one end of the cigarette is directly exposed to the outside. The electric heating device is not provided with a clamping device for fixing the cigarette. During smoking, the cigarette may fall off, and the tobacco residue generated in the heating process is also likely to fall off, and may hurt the user. Defect of no mouthpiece setting also include the cigarette being pulled out by mistake.

Therefore, to provide an aerosol-generating device that fixes the aerosol-generating substrate during smoking and prevents the user from pulling out the aerosol-generating substrate directly during removal is a problem to be solved in the art.

SUMMARY

The technical problem to be solved by the present disclosure is to provide an aerosol-generating device which fixes an aerosol-generating substrate during smoking and prevents the user from pulling out the aerosol-generating substrate directly during removal of the aerosol-generating substrate.

In order to solve the above technical problems, the present disclosure provides an aerosol-generating device comprising:

an extractor, comprising a storage portion and a mouthpiece that are detachably connected to each other, the storage portion and the mouthpiece jointly defining a cavity for accommodating an aerosol-generating substrate; and a main body, which is detachably connected to the extractor and further comprises a heater configured to pierce into the cavity and for heating the aerosol-generating substrate; wherein, the storage portion is disposed between the main body and the mouthpiece, when the storage portion and the mouthpiece are respectively subjected to forces in directions that are opposite in the axial direction, the end of the mouthpiece adjacent to the main body expands radially outward, so that the mouthpiece is detached from the storage portion; and prior to the extractor being detached from the main body, the main body restricts the end of the mouthpiece adjacent to the main body from expanding radially outward.

Further, the storage portion and the mouthpiece are connected by engaging or screw threading.

Further, the storage portion is sleeved by the end of the mouthpiece adjacent to the main body.

Further, the inner side of the end of the mouthpiece adjacent to the main body is provided with a gap, and the end of the mouthpiece adjacent to the main body can be deformed inward when subjected to a radially inward force.

Further, the radially inward force is a radially inward force applied by the main body to the mouthpiece during the separation of the extractor from the main body.

Further, the storage portion is sleeved by the end of the mouthpiece adjacent to the main body; the mouthpiece is engaged with the main body, and the end of the mouthpiece is inserted into the main body.

Further, the mouthpiece has two or more cantilevers, by which the mouthpiece is engaged with the storage portion and the main body.

Further, the cantilever is provided with a convex portion, the main body is provided with a concave portion, and the cantilever and the main body are engaged through the convex portion on the cantilever and the concave portion on the main body, alternatively, the cantilever is provided with a concave portion, the main body is provided with a convex portion, and the cantilever and the main body are engaged through the concave portion on the cantilever and the convex portion on the main body.

Further, the main body is provided with a guiding slot, along which the cantilever slides to a predetermined engaging position; and the aerosol-generating device is further provided with a heating indicator, the end of the mouthpiece away from the main body is eccentrically provided with a suction hole communicating with the cavity, and when the extractor slides to the predetermined engaging position, the suction hole is biased to the side where the heating indicator is.

Further, the storage portion is provided with a guiding portion on its outer surface, and the cantilever is provided with a guiding groove on its inner surface, wherein the mouthpiece and the storage portion can be engaged at a predetermined engaging position by fitting of the guiding portion with the guiding groove.

Further, the end of the cantilever connected to the main body has an uneven outer surface.

Further, the end of the storage portion away from the main body is provided with an eyelet, through which the heater can be at least partially inserted into the cavity.

In summary, the present disclosure provides an aerosol-generating device. The cavity defined together by the storage portion and the mouthpiece for accommodating the aerosol-generating substrate can effectively fix the aerosol-generating substrate, hereby preventing the aerosol-generating substrate or a tobacco residue from falling during a smoking process. In addition, when a user directly pulls an extractor out of a main body, that is, the storage portion and the mouthpiece are subjected to an axially force, the mouthpiece can radially expand outward such that the mouthpiece is separated from the storage portion. Before the extractor is detached from the main body, the main body would restrict the end of the mouthpiece adjacent to the main body from radially expanding outward. In this way, before the extractor is detached from the main body, the storage portion and the mouthpiece cannot be separated because the mouthpiece cannot radially expand outward, thereby preventing the user from directly and unintentionally pulling out the aerosol-generating substrate so as to ensure the cleanness of the cavity.

BRIEF DESCRIPTION OF THE DRAWINGS

The present disclosure is further described in detail below with reference to accompanying drawings and specific embodiments.

Elements are numbered as follows:

100—main body
111—circuit control board
112—circuit board bracket
113—button
114—indicator
121—case
122—bottom cover
130—support
131—guiding slot
140—heater
151—charging board
152—battery
200—extractor
210—mouthpiece
211—cantilever
212—suction hole
213—guiding groove
220—storage portion
221—guiding portion
230—aerosol-generating substrate

DESCRIPTION OF THE EMBODIMENTS

Preferred embodiments of the present disclosure will now be described in detail in conjunction with the drawings, Although the description of the present disclosure will be described in conjunction with the various embodiments, it is not intended that the features of the disclosure are limited to the embodiments. On the contrary, the purpose of the disclosure in conjunction with these embodiments is to cover other alternatives or modifications that may be extended according to the scope of the claims. In order to provide a thorough understanding of the present disclosure, the following description will include many specific details which may not be used in the present disclosure. In addition, some specific details will be omitted in the description in order to avoid confusion of the major features of the present disclosure.

In addition, "upper", "lower", "left", "right", "top", and "bottom" used in the following description are set to better describe the preferred embodiment of the present disclosure. It should not be construed as a limitation of the disclosure.

Figure 1:
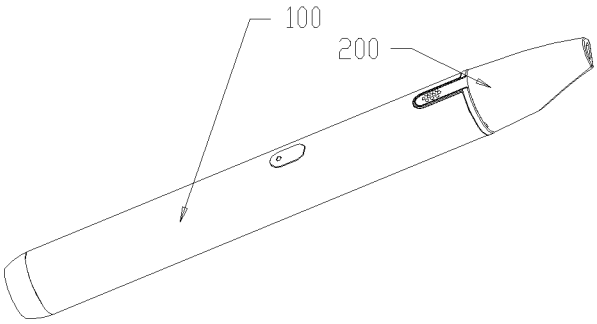
FIG. 1 is a schematic structural view of an aerosol-generating device according to the present disclosure.
Figure 2:
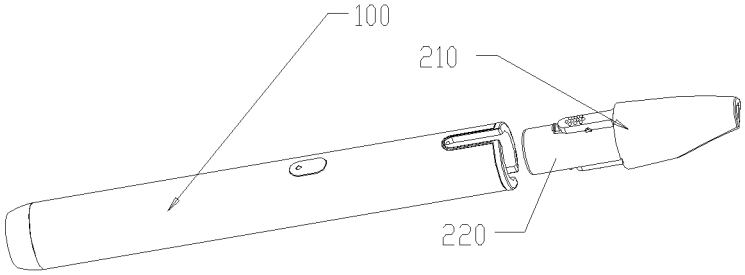
FIG. 2 is a schematic view showing the semi-exploded structure of the aerosol-generating device according to the present disclosure.
Figure 3:
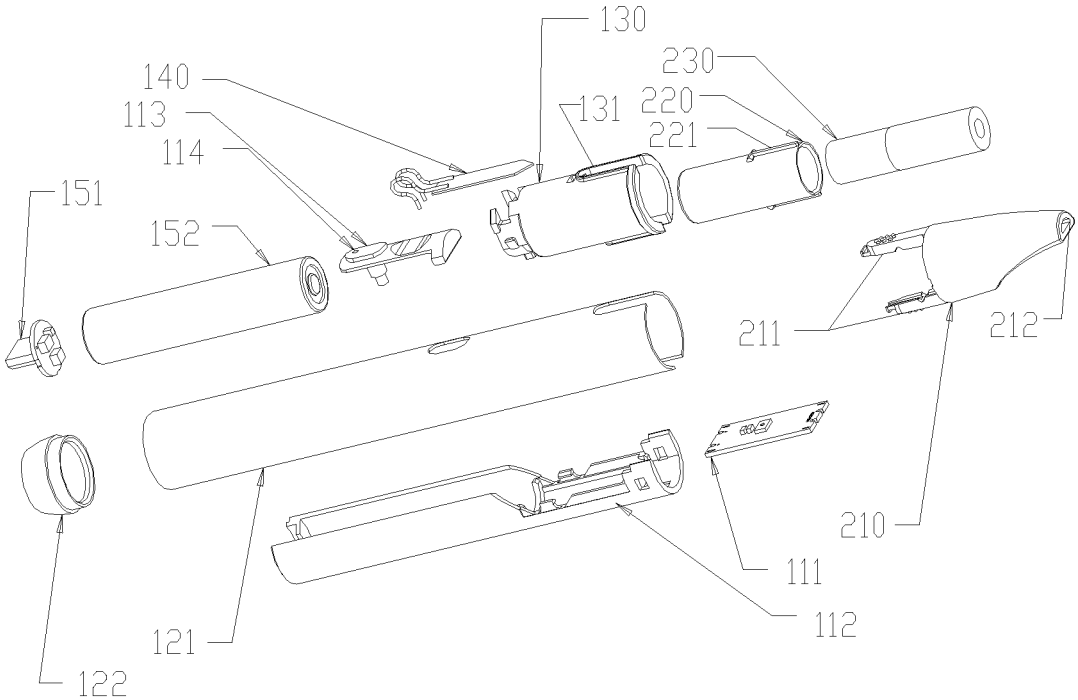
FIG. 3 is a schematic exploded view of the aerosol-generating device according to the present disclosure.

The aerosol-generating device provided by the present disclosure, as shown in FIGS. 1 to 3, comprises an extractor 200 and a main body 100. The extractor 200 comprises a storage portion 220 and a mouthpiece 210 that are detachably connected to each other, the storage portion 220 and the mouthpiece 210 jointly defining a cavity for accommodating an aerosol-generating substrate; the main body 100 which is detachably connected to the extractor 200 and further comprises a heater 140 configured to pierce into the cavity and for heating the aerosol-generating substrate; wherein, the storage portion 220 is disposed between the main body 100 and the mouthpiece 210; when the storage portion 220 and the mouthpiece 210 are respectively subjected to forces in directions that are opposite in the axial direction, the end of the mouthpiece 210 adjacent to the main body 100 expands radially outward, so that the mouthpiece 210 is detached from the storage portion 220; and prior to the extractor 200 being detached from the main body 100, the main body 100 restricts the end of the mouthpiece 210 adjacent to the main body 100 from expanding radially outward. In this way, before the extractor 200 is detached from the main body 100, the storage portion 220 and the mouthpiece 210 cannot be separated because the mouthpiece 210 cannot radially expand outward, thereby preventing the user from directly and unintentionally pulling out the aerosol-generating substrate 230 so as to ensure the cleanness of the cavity.

Further, the main body 100 further includes a circuit control portion and a power supply device. The circuit control portion includes a button 113, a circuit control board 111, and a circuit board bracket 112 for fixing the circuit control board 111. Press the button 113 to control the start and stop of the heater 140 through the circuit control board 111, and the button 113 is provided with an indicator 114 for displaying the working state of the main body 100. The power supply device may be an external power supply or a single-use battery, as long as it can be used to supply power to the circuit control portion and the heater. Preferably, as shown in FIG. 3, the power supply device is composed of a charging board 151 and a battery 152. The charging board 151 can charge the battery 152 to ensure that the power supply device can be used repeatedly.

Further, the main body 100 further includes a support 130, a case 121 and a bottom cover 122. The case 121 and the support 130 may be two independent structures as shown in FIG. 3, or may be an integrally formed structure, as long as the case 121 and the support 130 can realize the aforementioned function that the main body 100 restricts the end of the mouthpiece 210 adjacent to the main body 100 from expanding radially outward.

Figure 4:
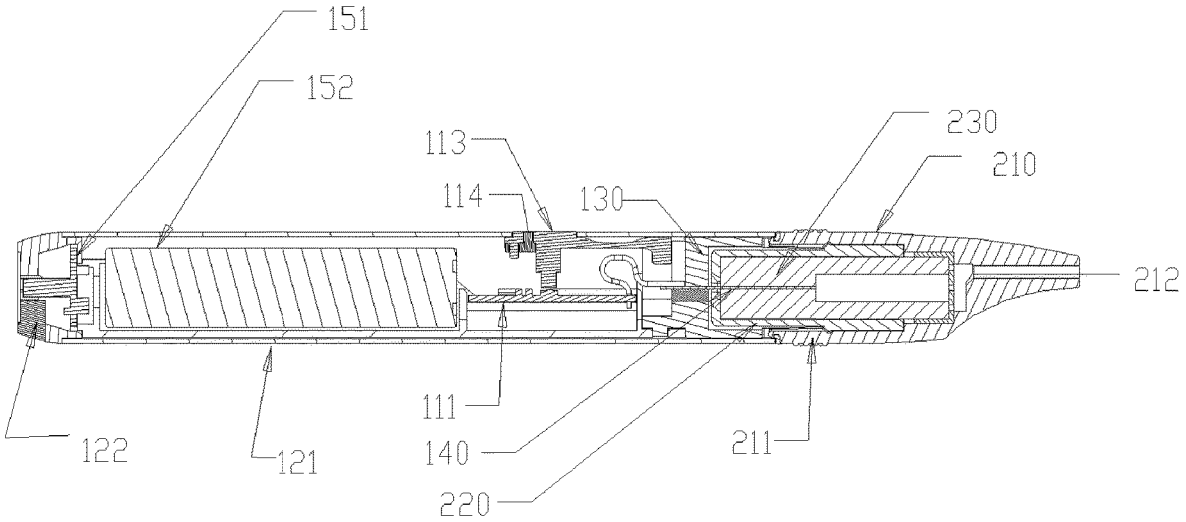
FIG. 4 is a schematic cross-sectional structural view of the aerosol-generating device according to the present disclosure.
Figure 5:
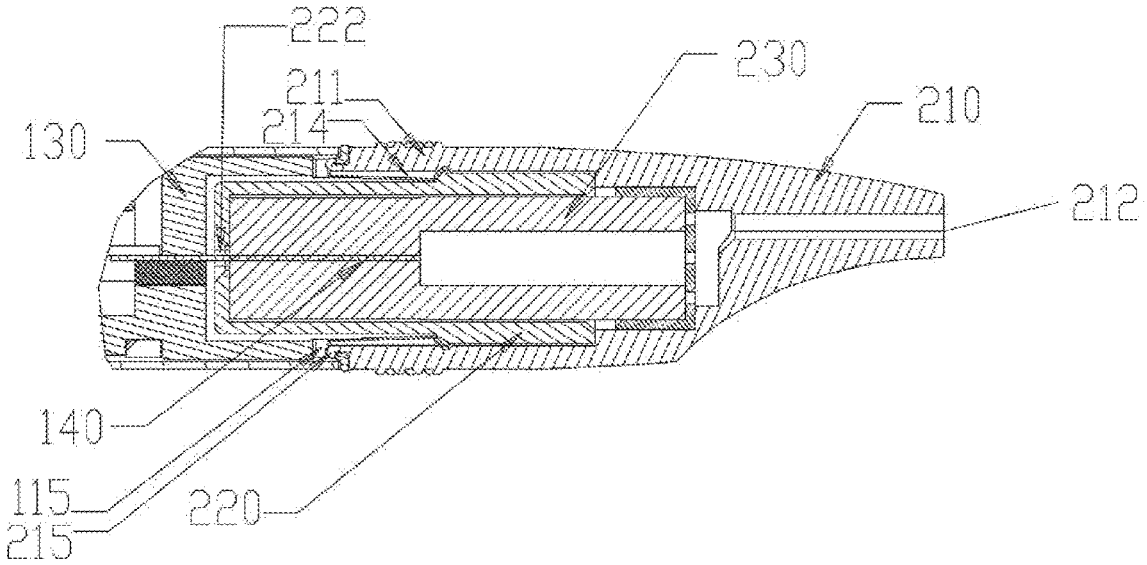
FIG. 5 is a partial cross-sectional enlarged structural view of the aerosol-generating device according to the present disclosure.

Further, the storage portion 220 and the mouthpiece 210 can be connected via a detachable connection common in the art, from the aspects of convenient operation and simplified structure, preferably, in one embodiment, the storage portion 220 and the mouthpiece 210 are connected by the snap-fit shown in FIGS. 4 and 5, in another embodiment, the storage portion 220 and the mouthpiece 210 can also be connected by screw threading (not shown).

Further, it is preferable that the storage portion 220 is sleeved by the end of the mouthpiece 210 adjacent to the main body 100, hereby, when the user pulls out the mouthpiece 210 from the main body 100, in other words, when the storage portion 220 and the mouthpiece 210 are respectively subjected to forces in directions that are opposite in the axial direction, the end of the mouthpiece 210 adjacent to the main body 100 must expand radially outward, so that the mouthpiece 210 is detached from the storage portion 220.

Further, prior to the extractor 200 being detached from the main body 100, the main body 100 restricts the end of the mouthpiece 210 adjacent to the main body 100 from expanding radially outward. As shown in FIGS. 4 and 5, the storage portion 220 is sleeved by the end of the mouthpiece 210 adjacent to the main body; when the storage portion 220 and the mouthpiece 210 are connected by engaging or screw threading, a portion of the mouthpiece 210 connected to the storage portion 220 needs to be deformed outward, that is, the portion has a certain amount of radial outward expansion to allow the storage portion 220 to be directly pulled out from the mouthpiece 210. In the present disclosure, prior to the extractor 200 being detached from the main body 100, as the storage portion 220 is sleeved by the end of the mouthpiece 210 adjacent to the main body, the main body 100 restricts the end of the mouthpiece 210 adjacent to the main body 100 from expanding radially outward, it is effective to avoid directly pulling the storage portion 220 out of the mouthpiece 210.

Further, as shown in FIGS. 4 and 5, the inner side of the end of the mouthpiece 210 adjacent to the main body 100 is provided with a gap 214, and the end of the mouthpiece 210 adjacent to the main body 100 can be deformed inward when subjected to a radially inward force, the radially inward force may be a force applied by the main body 100 to the mouthpiece 210 during the separation of the extractor 200 from the main body 100, or may be a force applied by the user pressing the locking region, which separates the extractor 200 from the main body 100. By the gap 214 provided inside the end of the mouthpiece 210 adjacent to the main body 100, the end of the mouthpiece 210 adjacent to the main body 100 can be deformed inward to further lock the mouthpiece 210 and the extractor 200 when subjected to a radially inward force. The mouthpiece 210 and the storage portion 220 are prevented from being separated due to the axial pulling force when the extractor 200 is pulled out.

Further, as shown in FIG. 4 and FIG. 5, the storage portion 220 is sleeved by the end of the mouthpiece 210 adjacent to the main body 100; the mouthpiece 210 is engaged with the main body 100, and the end of the mouthpiece 210 is inserted into the main body 100, in such a configuration, before the extractor 200 is separated from the main body 100, since the end of the mouthpiece 210 is located inside the main body 100, the end of the mouthpiece 210 inserted into the main body 100 can be effectively prevented from being deformed outward, thereby avoiding directly pulling the storage portion 220 out of the mouthpiece 210.

Further, as shown in FIGS. 4 and 5, the mouthpiece 210 has two or more cantilevers 211, by which the mouthpiece 210 is engaged with the storage portion 220 and the main body 100, respectively. The engagement between the main body 100 and the cantilever 211 may be that the cantilever 211 is provided with a convex portion 215, the main body 100 is provided with a concave portion 115, and the cantilever 211 and the main body 100 are engaged through the convex portion 215 on the cantilever 211 and the concave portion 115 on the main body 100, alternatively, the cantilever 211 is provided with a concave portion, the main body 100 is provided with a convex portion, and the cantilever 211 and the main body 100 are engaged through the concave portion on the cantilever 211 and the convex portion on the main body 100.

Further, the end of the cantilever 211 connected to the main body 100 has an uneven outer surface. This can help the user quickly to determine the portion at which the mouthpiece 210 is engaged with the main body 100, and the extractor 200 can be quickly pulled out from the main body 100 by pressing the portion.

Further, as shown in FIG. 3, the aerosol-generating device is further provided with a heating indicator 114. The main body 100 is provided with a guiding slot 131, along which the cantilever 211 slides to a predetermined engaging position; in order to fit the mouth shape and improve the user's feeling, the end of the mouthpiece 210 away from the main body 100 is eccentrically provided with a suction hole 212 communicating with the cavity, and when the extractor 200 slides to the predetermined engaging position, the suction hole 212 is biased to the side where the heating indicator 114 is, in this way, the user can monitor whether the aerosol-generating device is in working state in real time.

Figure 6:
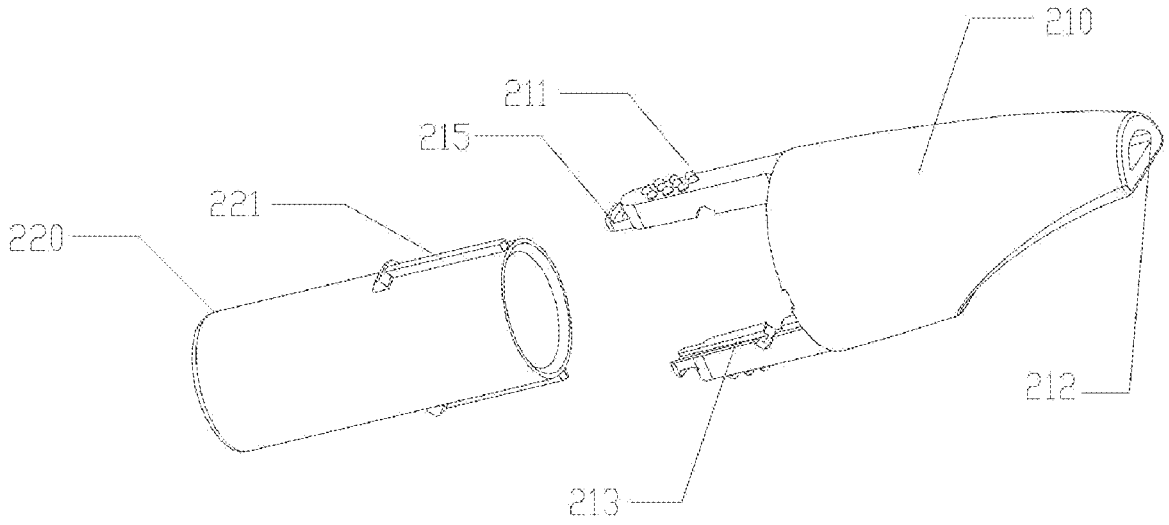
FIG. 6 is an enlarged schematic exploded view of an extractor according to the present disclosure.

Further, the end of the storage portion 220 away from the main body 100 is provided with an eyelet 222, through which the heater 140 can be at least partially inserted into the cavity. When the shape of the portion of the heater 140 inserted into the cavity is non-circular, if the relative position of the storage portion 220 and the main body 100 is not fixed, in order to insert the heater 140 into the cavity, it is preferable to set the narrowest portion of the eyelet 222 larger than the widest portion of the heater 140 inserted into the cavity; and when the extractor is pulled out from the main body 100, preferably, the shape of the eyelet 222 matches the shape of the heater 140, so that the tobacco residue on the surface of the heater 140 is scraped off by the storage portion 220. In the present disclosure, as shown in FIG. 6, the storage portion 220 is provided with a guiding portion 221 on its outer surface, and the cantilever 211 is provided with a guiding groove 213 on its inner surface, wherein the mouthpiece 210 and the storage portion 220 can be engaged at a predetermined engaging position by fitting of the guiding portion 221 with the guiding groove 213. By providing the corresponding guiding portion 221 and the guiding groove 213, in addition to making it easier for the user to connect the storage portion 220 and the mouthpiece 210, the mouthpiece 210 and the storage portion 220 can always be connected at a fixed engaging position, and the extractor 200 and the main body 100 are also connected at a fixed engaging position, so that the relative position of the storage portion 220 and the main body 100 are always fixed, hereby, the shape and position of the eyelet 222 in the bottom of the storage portion 220 can be set according to the shape and position of heater 140. The eyelet 222 can be slightly larger than the heater 140. When the extractor 200 is pulled out from the main body 100, the tobacco residue on the surface of the heater 140 is scraped off by the storage portion 220, so as to prevent tobacco residues from falling inside the main body 100 and ensure the cleanness of the main body 100.

In summary, the present disclosure provides an aerosol-generating device. The cavity defined together by the storage portion and the mouthpiece for accommodating the aerosol-generating substrate can effectively fix the aerosol-generating substrate, hereby preventing the aerosol-generating substrate or a tobacco residue from falling during a smoking process. In addition, when a user directly pulls an extractor out of a main body, that is, the storage portion and the mouthpiece are subjected to an axially force, the mouthpiece can radially expand outward such that the mouthpiece is separated from the storage portion. Before the extractor is detached from the main body, the main body would restrict the end of the mouthpiece adjacent to the main body from radially expanding outward. In this way, before the extractor is detached from the main body, the storage portion and the mouthpiece cannot be separated because the mouthpiece cannot radially expand outward, thereby preventing the user from directly and unintentionally pulling out the aerosol-generating substrate so as to ensure the cleanness of the cavity.

The foregoing description presents the specific embodiments of the present disclosure for the purpose of illustrating the inventive concept of the present disclosure more clearly, but it is not intended to limit the scope of the claims of the present disclosure. According to the inventive concept of the present disclosure, those of ordinary skill in the art will be able to easily adapt and modify the above-described embodiments, the variations and modifications of which are all within the scope of the present disclosure as defined by the claims of the present disclosure.

The invention claimed is:

1. An aerosol-generating device, comprising:

an extractor, comprising a storage portion and a mouthpiece that are detachably connected to each other, the storage portion and the mouthpiece jointly defining a cavity for accommodating an aerosol-generating substrate; and a main body, which is detachably connected to the extractor and further comprises a heater configured to pierce into the cavity and for heating the aerosol-generating substrate;

wherein:

the storage portion is disposed between the main body and the mouthpiece, wherein, when the storage portion and the mouthpiece are respectively subjected to forces in directions that are opposite in the axial direction, the end of the mouthpiece adjacent to the main body expands radially outward, so that the mouthpiece is detached from the storage portion; and prior to the extractor being detached from the main body, the main body restricts the end of the mouthpiece adjacent to the main body from expanding radially outward.

2. An aerosol-generating device according to claim 1, wherein the end of the storage portion away from the main body is provided with an eyelet, through which the heater can be at least partially inserted into the cavity.

3. An aerosol-generating device according to claim 1, wherein the storage portion is sleeved by the end of the mouthpiece adjacent to the main body; the mouthpiece is engaged with the main body, and the end of the mouthpiece is inserted into the main body.

4. An aerosol-generating device according to claim 3, wherein the mouthpiece has two or more cantilevers, by which the mouthpiece is engaged with the storage portion and the main body.

5. An aerosol-generating device according to claim 1, wherein the storage portion and the mouthpiece are connected by engaging or screw threading.

6. An aerosol-generating device according to claim 5, wherein the storage portion is sleeved by the end of the mouthpiece adjacent to the main body; the mouthpiece is engaged with the main body, and the end of the mouthpiece is inserted into the main body.

7. An aerosol-generating device according to claim 6, wherein the mouthpiece has a cantilever, by which the mouthpiece is engaged with the storage portion and the main body.

8. An aerosol-generating device according to claim 7, wherein the cantilever is provided with a convex portion, the main body is provided with a concave portion, and the cantilever and the main body are engaged through the convex portion on the cantilever and the concave portion on the main body.

9. An aerosol-generating device according to claim 7, wherein the main body is provided with a guiding slot, along which the cantilever slides to a predetermined engaging position; and the aerosol-generating device is further provided with a heating indicator on a side, the end of the mouthpiece away from the main body is eccentrically provided with a suction hole communicating with the cavity, and when the cantilever slides to the predetermined engaging position, the suction hole is biased to the side where the heating indicator is.

10. An aerosol-generating device according to claim 7, wherein the end of the cantilever connected to the main body has an uneven outer surface.

11. An aerosol-generating device according to claim 5, wherein the storage portion is sleeved by the end of the mouthpiece adjacent to the main body.

12. An aerosol-generating device according to claim 11, wherein the storage portion is sleeved by the end of the mouthpiece adjacent to the main body; the mouthpiece is engaged with the main body, and the end of the mouthpiece is inserted into the main body.

13. An aerosol-generating device according to claim 11, wherein the inner side of the end of the mouthpiece adjacent to the main body is provided with a gap, and the end of the mouthpiece adjacent to the main body can be deformed inward when subjected to a radially inward force.

14. An aerosol-generating device according to claim 13, wherein the storage portion is sleeved by the end of the mouthpiece adjacent to the main body; the mouthpiece is engaged with the main body, and the end of the mouthpiece is inserted into the main body.

15. An aerosol-generating device according to claim 14, wherein the mouthpiece has a cantilever, by which the mouthpiece is engaged with the storage portion and the main body.

16. An aerosol-generating device according to claim 15, wherein the storage portion is provided with a guiding portion on its outer surface, and the cantilever is provided with a guiding groove on its inner surface, wherein the mouthpiece and the storage portion can be engaged at a predetermined engaging position by fitting of the guiding portion with the guiding groove.

17. An aerosol-generating device according to claim 13, wherein the radially inward force is a radially inward force applied by the main body to the mouthpiece during the detachment of the extractor from the main body.

18. An aerosol-generating device according to claim 17, wherein the storage portion is sleeved by the end of the mouthpiece adjacent to the main body; the mouthpiece is engaged with the main body, and the end of the mouthpiece is inserted into the main body.

* * * * *